United States Patent [19]

Ide et al.

[11] 4,392,086

[45] Jul. 5, 1983

[54] APPARATUS FOR OPERATING A GASEOUS DISCHARGE LAMP

[75] Inventors: Katsuyuki Ide; Kempo Ohe, both of Yokohama; Hisao Kobayashi, Fujisawa, all of Japan

[73] Assignee: Toshiba Electric Equipment Corporation, Tokyo, Japan

[21] Appl. No.: 190,269

[22] Filed: Sep. 24, 1980

[30] Foreign Application Priority Data

Sep. 28, 1979 [JP] Japan ..... 54/125666

[51] Int. Cl.[3] ..... H05B 41/29; H05B 41/36

[52] U.S. Cl. ..... 315/174; 315/105; 315/173; 315/171; 315/176; 315/199; 315/205; 315/224; 315/291; 315/DIG. 4

[58] Field of Search ..... 315/105, 106, 171-176, 315/194, 199, 205, 209 R, 219, 224, 247, 291, DIG. 4, DIG. 7; 307/44, 75, 82

[56] References Cited

U.S. PATENT DOCUMENTS 3,969,652 7/1976 Herzog ..... 315/224
4,017,785 4/1977 Perper ..... 315/221
4,109,307 8/1978 Knoll ..... 315/205 X

FOREIGN PATENT DOCUMENTS 50-826157 12/1975 Japan .

*Primary Examiner*—Eugene La Roche
*Attorney, Agent, or Firm*—Oblon, Fisher, Spivak, McClelland & Maier

[57] ABSTRACT

An apparatus for a gaseous discharge lamp includes a power controlling device for converting an AC voltage into a phase control output, a high frequency generating device for converting the output of the high frequency generating device into an high frequency output and a discharge lamp which is lighted by the output of the high frequency generating device and whose filament is heated. The high frequency generating device includes a DC power source for supplying a DC voltage to the power controlling device whenever the power controlling device remains to generate the phase control output. The output of the DC power source heats the filament of the discharge lamp for a period during which no phase control output is produced.

6 Claims, 17 Drawing Figures

APPARATUS FOR OPERATING A GASEOUS DISCHARGE LAMP

BACKGROUND OF THE INVENTION

FIELD OF THE INVENTION

This invention relates to an apparatus for operating a gaseous discharge lamp and, more particularly, to an apparatus which converts an intermittent output of a power controller into a high frequency voltage and which supplies the high frequency voltages thus obtained to a gaseous discharge lamp so as to light the lamp.

DESCRIPTION OF THE PRIOR ART

Gaseous discharge lamps lighted by a high frequency voltage are known, which are small and light in weight and which has a high light-emitting efficiency. But hitherto unknown is a gaseous discharge lamp which is lighted by a high frequency voltage, which undergoes light control by means of a phase controller and which has its filament heated to a proper temperature. In deed there is known a gaseous discharge lamp which is lighted by a commercial AC power source and which undergoes light control by means of a phase controller. But this light control system is large and heavy and has a low light-emitting efficiency. To make matters worse, the light control system requires one wire to connect the input of the phase controller to an operating unit of the gaseous discharge lamp. This is because if the phase control output of the phase controller is to light a fluorescent lamp, the filament of the fluorescent lamp has to be always supplied with a heating current. And a wire is required for supply the heating current to the filament of the fluorescent lamp. This is attributable to the fact that a heating current must be continuously supplied to the filaments of the fluorescent lamp for lighting the fluorescent lamp with the phase controlled current supplied from the phase controller, requiring another wire for feeding this heating current. For converting an already-existing power source system for a fluorescent lamp into a fluorescent lamp light control system, a phase controller must be arranged in the room wall, for example, to mount a lighting unit for the phase controller instead of the lighting unit which has been already mounted in the room ceiling, and new wiring must be arranged in the room in addition to the already-existing two wires. This new wiring requires much labor and makes the fluorescent lamp light control system costly. Moreover, when three wires are wired in a room for the fluorescent lamp light control system, the lighting unit may be erroneously connected to the wires.

SUMMARY OF THE INVENTION

It is, therefore, the primary object of the present invention to provide an apparatus for operating a gaseous discharge lamp which is small and light in weight and which is still capable of supplying a heating current to the filament of the gaseous discharge lamp.

To the above and other ends, the present invention provides an apparatus for operating gaseous discharge lamp including:

an electric power source for producing an AC voltage;

a power control device for controlling the phase angle of the AC voltage of the power source and generating an output voltage during the power supply period in any half cycle of the AC voltage;

an inverter inverting the output voltage of the power control device to a high frequency voltage;

an auxiliary power source for supplying an auxiliary power to the inverter during at least a rest between the power supply periods; and a gaseous discharge lamp which is energized and whose filaments are heated by a high frequency output from said inverting means.

BRIEF DESCRIPTION OF THE DRAWINGS

This invention can be more fully understood from the following detailed description when taken in conjunction with the accompanying drawings, in which.

DETAILED DESCRIPTION OF THE PREFERRED EMBODIMENTS

Figure 1:
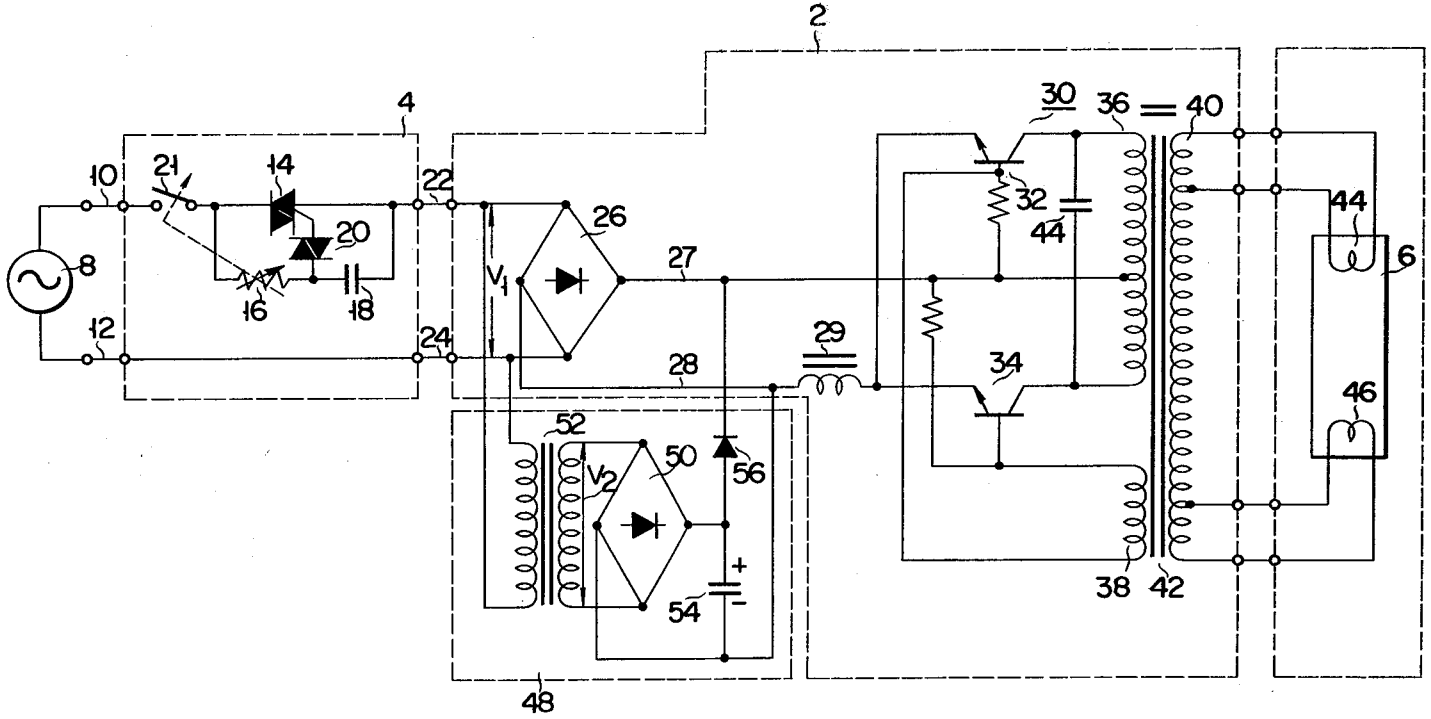
FIG. 1 is a circuit diagram of an apparatus for operating a gaseous discharge lamp in accordance with one embodiment of the present invention.

Referring to FIG. 1, a high frequency voltage generating unit 2 is connected between an electric power controller or phase controller 4 for controlling the phase angle of the AC current to be supplied as is well known and a fluorescent lamp 6. The power controller 4 is connected to an AC power source 8 through power supply lines 10, 12. The phase controller 4 is provided with a triac 14 which is connected to the power supply line 10. A series circuit consisting of a variable resistor 16 and a capacitor 18 is connected in parallel with the triac 14 for firing the triac 14 at an arbitrarily selected phase angle for conduction. A diac 20 is connected between a node of the variable resistor 16 and the capacitor 18, and the gate of the triac 14. A power switch 21 is connected between the AC power supply line 10 and the triac 14. By varying the resistance of the variable resistor 16, the phase controller 4 supplies a voltage whose phase angle is controlled to two connecting wires 22, 24 which connect the phase controller 4 and a rectifying circuit 26 of the unit 2. According to the present invention, the AC power source may be replaced by a DC power source. If a DC power source is used, the rectifying circuit 26 is unnecessary. The phase controller is not limited to the type shown in the drawings. Some other types are possible. For example, the power control unit may be comprised of switching elements, e.g. transistors, which control an DC voltage supply period.

The first full-wave rectifying circuit 26 is connected to an inverter 30 for converting the DC voltage supplied from the rectifying circuit 26 through lines 27, 28 into a high frequency voltage. An inductor 29 is connected to the line 28 for preventing a high frequency component from supplying to the rectifying circuit 26. The inverter 30, as shown in the drawing, has a pair of push-pull transistors 32, 34. The inverter 30 further includes a transformer or leakage reactance transformer 42 having a primary winding 36; and first and second secondary windings 38, 40 for inducing a high frequency voltage in the secondary windings 38, 40 and a resonance capacitor 44 connected to the first primary winding 36. The fluorescent lamp 6 is connected to the secondary winding 40 of the transformer 42 through sockets (not shown). Filaments 44, 46 of the fluorescent lamp 6 are connected through sockets between terminal and intermediate taps of the secondary winding 40.

The high frequency voltage generating unit 2 includes a DC power source 48 for supplying a heater current to the filaments 44, 46 of the fluorescent lamp 6 even when the triac 14 is non-conductive. The DC power source 48 has a transformer 52 whose primary winding is connected to connecting wires 22, 24 and whose secondary winding is connected to a second full-wave rectifying circuit 50. A capacitor 54 is connected to the output of the full-wave rectifying circuit 50 for supplying a DC current to the inverter 30 when the voltage across the line 27 is decreased. The capacitor 54 is connected between the lines 27, 28 through a diode 56. For example, the turn ratio of the primary and secondary windings of the transformer 52 is set to be smaller than the discharge sustaining voltage of the fluorescent lamp 6 and to charge the capacitor 54 with a voltage capable of supplying a sufficient pre-heating current to the filaments 44, 46 of the fluorescent lamp 6 during the period in which the triac 14 is non-conductive. However, this invention is not always restricted to this turn ratio.

Figure 2A:
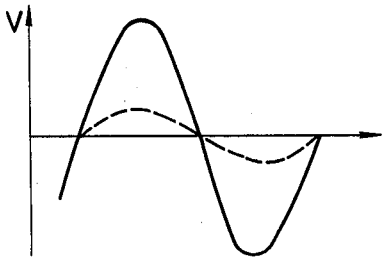
FIGS. 2A, 3A and 4A are waveform charts illustrating the AC voltage supplied from the phase control unit.
Figure 2B:
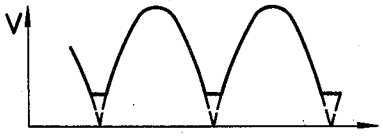
FIGS. 2B, 3B and 4B are waveform charts illustrating the rectified voltage supplied to the inverter.
Figure 2D:
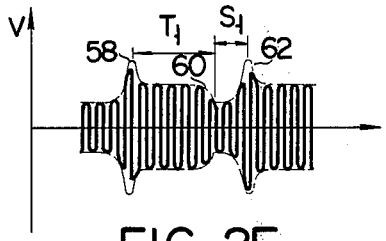
FIGS. 2D, 3D and 4D are waveform charts illustrating the high frequency voltage supplied to the fluorescent lamp from the secondary winding of the leakage reactance transformer.
Figure 2E:
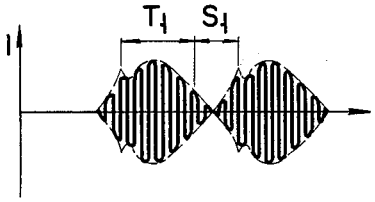
FIGS. 2E, 3E and 4E are waveform charts illustrating the high frequency current supplied to the fluorescent lamp.
Figure 3E:
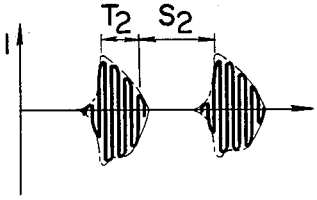

In apparatus for operating a fluorescent lamp of the type described, when the variable resistor 16 is set so that the fluorescent lamp 6 lights up at maximum power and the power switch 21 is closed, an AC voltage V1 as shown by the solid line in FIG. 2A is supplied from the phase controller 4 to the first rectifying circuit 26 and the primary winding of the transformer 52. Then, an AC voltage as shown by the broken lines in FIG. 2A is generated across the secondary winding of the transformer 52. This AC voltage is rectified by the second rectifying circuit 50 and charges the capacitor 54 with a polarity as shown in the drawing. The first rectifying circuit 26 rectifies the applied AC voltage and generates a full-wave rectified voltage across the lines 27, 28. The voltage supplied by the circuit 26 to the line 27 is lower than the charging voltage of the capacitor 54 at every half cycle. At every half cycle, the diode 56 is rendered conductive, and a DC current is supplied from the capacitor 54 to the line 27. As a result, the voltage supplied from the capacitor 54 is superposed on the rectified voltage of the first rectifying circuit 26, a voltage V3 as shown in FIG. 2B being applied across the lines 27, 28. The rectified voltage V3 shown in FIG. 2B is converted by the inverter 30 into a high frequency voltage V4 of about 20–40 kHz to be applied to the primary winding 36 of the leakage reactance transformer 42. Thus, a high frequency voltage V5 as shown in FIG. 2D is applied to the fluorescent lamp 6 through the secondary winding 40 of the transformer 42, and a high frequency current I5 as shown in FIG. 2E is supplied to the fluorescent lamp 6. When the high frequency voltage V5 shown in FIG. 2D reaches a discharge initiating voltage shown by symbol 58, the fluorescent lamp 6 starts discharging, thereafter the lamp voltage being reduced to the discharge sustaining voltage. During a time period T1 until the voltage V5 is below the discharge sustaining voltage, the fluorescent lamp 6 continues to discharge at the high frequency voltage. When the high frequency voltage V5 drops below a discharge interrupting voltage shown by symbol 60, the fluorescent lamp 6 stops discharging. After a discharge interrupting period S1 elapses and the high frequency voltage reaches the discharge initiating voltage shown by symbol 62, the fluorescent lamp 6 starts discharging again. The high frequency voltage shown in FIG. 2D is applied to the filaments of the fluorescent lamp and a high frequency current whose waveform is similar to that of the voltage shown in FIG. 2D flows through the filaments. Thus, the DC current fed from the DC power source 48 is converted into a high frequency voltage which is fed from the transformer 42 to the filaments.

Figure 3A:
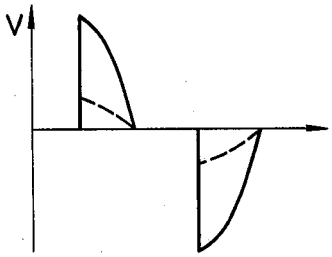
Figure 3B:
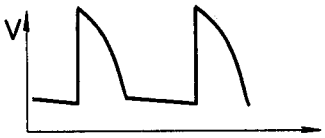
Figure 2C:
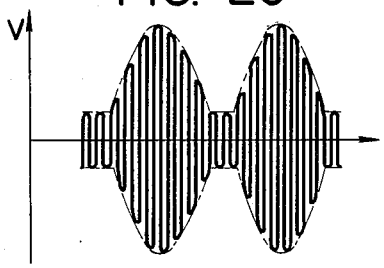
FIGS. 2C, 3C and 4C are waveform charts illustrating the high frequency voltage supplied to the primary winding of the leakage reactance transformer.
Figure 3C:
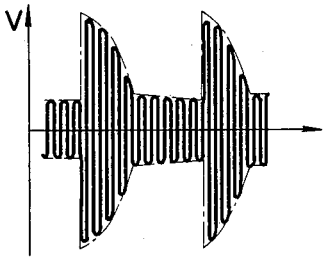
Figure 3D:
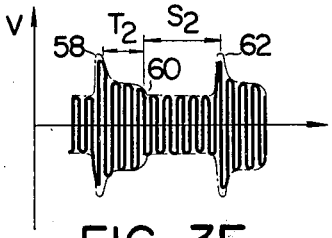

When the variable resistor 16 of the phase controller 4 is set to light the fluorescent lamp 6 at a 50% light controlled rate, a light controlled AC voltage V1 whose phase angle is controlled as shown by the solid line in FIG. 3A is applied from the phase controller 4 to the first rectifying circuit 26 and to the primary winding of the transformer 52. An AC voltage V2 as shown by the broken lines in FIG. 3A is applied to the rectifying circuit 50 to charge the capacitor 54. Since the diode 56 is rendered conductive every time the voltage across the line 27 is lower than the predetermined voltage, a rectified voltage as shown in FIG. 3B is generated across the lines 27, 28. As may be apparent from a comparison of FIGS. 3A with 3B, a voltage is applied from the DC voltage source 48 to the lines 27, 28 even while the triac 14 is non-conductive. A rectified voltage as shown in FIG. 3B is applied to the inverter 30 through the lines 27, 28 and consequently a high frequency voltage as shown in FIG. 3C is generated across the primary winding 36 of the leakage reactance transformer 42. Thus, a high frequency voltage as shown in FIG. 3D is generated across the secondary winding 40 of the leakage reactance transformer 42, the fluorescent lamp 6 discharges for a discharge period T2 and is substantially extinguished for a discharge interrupting period S2. The current having the waveform similar to FIG. 3D is supplied to the filaments 44, 46 of the fluorescent lamp 6 by the DC voltage from the DC voltage source 48 even during the discharge interrupting period S2. Thus, even if the triac 14 of the phase controller 4 alternates conduction and non-conduction, the filament current is constantly supplied to the filaments 44, 46 of the fluorescent lamp 6. Thus, the fluorescent lamp 6 correctly starts to discharge and is alternately lit and extinguished even when the discharge interrupting period S2 is under a relatively long 50% light controlled condition.

Figure 4A:
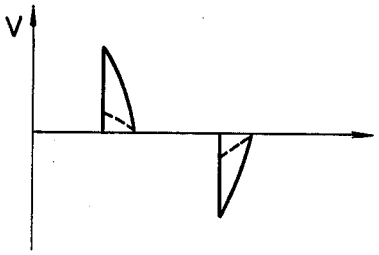
Figure 4B:
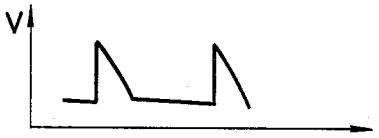
Figure 4C:
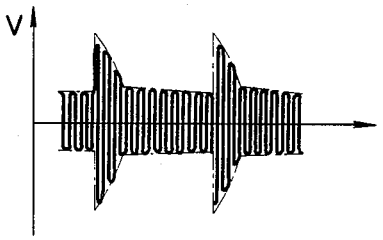
Figure 4D:
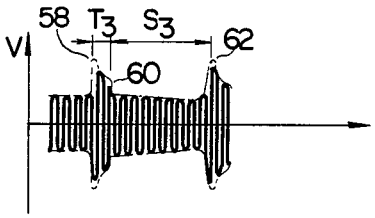
Figure 4E:
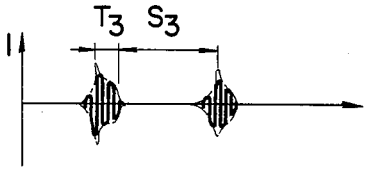

Further, even when the phase controller 4 is set under a 20% dimming condition and the non-conductive period of the triac 14 is made longer, a voltage as shown in FIGS. 4A–4D is generated across various points of the circuit so that a current having the waveform similar to FIG. 4D is supplied to the filaments of the fluorescent lamp 6. Thus, the fluorescent lamp 6 is lit under the condition of a 20% light controlled rate.

FIG. 4A shows the AC voltage applied from the phase controller 13; FIG. 4B, the rectified voltage across the lines 27, 28; FIG. 4C, the high frequency voltage supplied to the primary winding of the transformer 42; and FIG. 4D, the high frequency voltage supplied to the fluorescent lamp 6 from the secondary winding 40 of the transformer 42. In the drawings, T3 denotes the discharge period and S3 denotes the discharge interrupting period. As may be apparent from FIG. 4D, even during the discharge interrupting period S3, a voltage is supplied to the filaments 44, 46 of the fluorescent lamp 6 so that the repetition and the start of the discharge of the fluorescent lamp 6 may be correctly attained in the light controlled condition and 20% light controlled condition may be maintained.

As has been described, the DC power source 48 is included which is capable of providing a sufficient current to the operating circuit 2 of the fluorescent lamp for pre-heating the filaments 44, 46 even under a low light controlled condition and supplying a voltage that is less than the discharge sustaining voltage of the fluorescent lamp 6. Thus, the fluorescent lamp 6 may be lit under any light controlled condition, for example, under a 10% light controlled condition. The table presented below shows the characteristics of one fluorescent lamp 6 of 40 W wherein the capacitor 54 has a capacitance of 22 $\mu$F. In the table, $\psi$ represents the phase angle at which the triac 14 is fired and is represented as the ratio of the phase angle $\psi$ to $\pi$. Vc denotes the charging voltage of the capacitor 54, and $T_F$ is the filament temperature when the pre-heating current is supplied to the filaments 44, 46 of the fluorescent lamp 6. The light controlled rate is the intensity of the light when the intensity of light under the uncontrolled condition is taken as 100%.

TABLE

| $\psi/\pi$ | Vc | $T_F$ | light controlled rate |
|---|---|---|---|
| 0 | 130 V | 1,088° C. | 100% |
| 0.5 | 110 V | 1,010° C. | 50% |
| 0.7 | 80 V | 850° C. | 15% |

As is apparent from the above table, the fluorescent lamp 6 may be lit at various light controlled rates in accordance with the present invention. Further, as shown in FIG. 1, since the phase controller 4 and the high frequency voltage generating unit 2 are connected by the connecting wires 22, 24, the phase controller 4 may be set remote from the other units and the wiring is easier than the conventional fluorescent lamp light control system so that the problem of erroneous wiring may be eliminated. Further, the present invention can be applied to an already-existing fluorescent power system.

Figure 5:
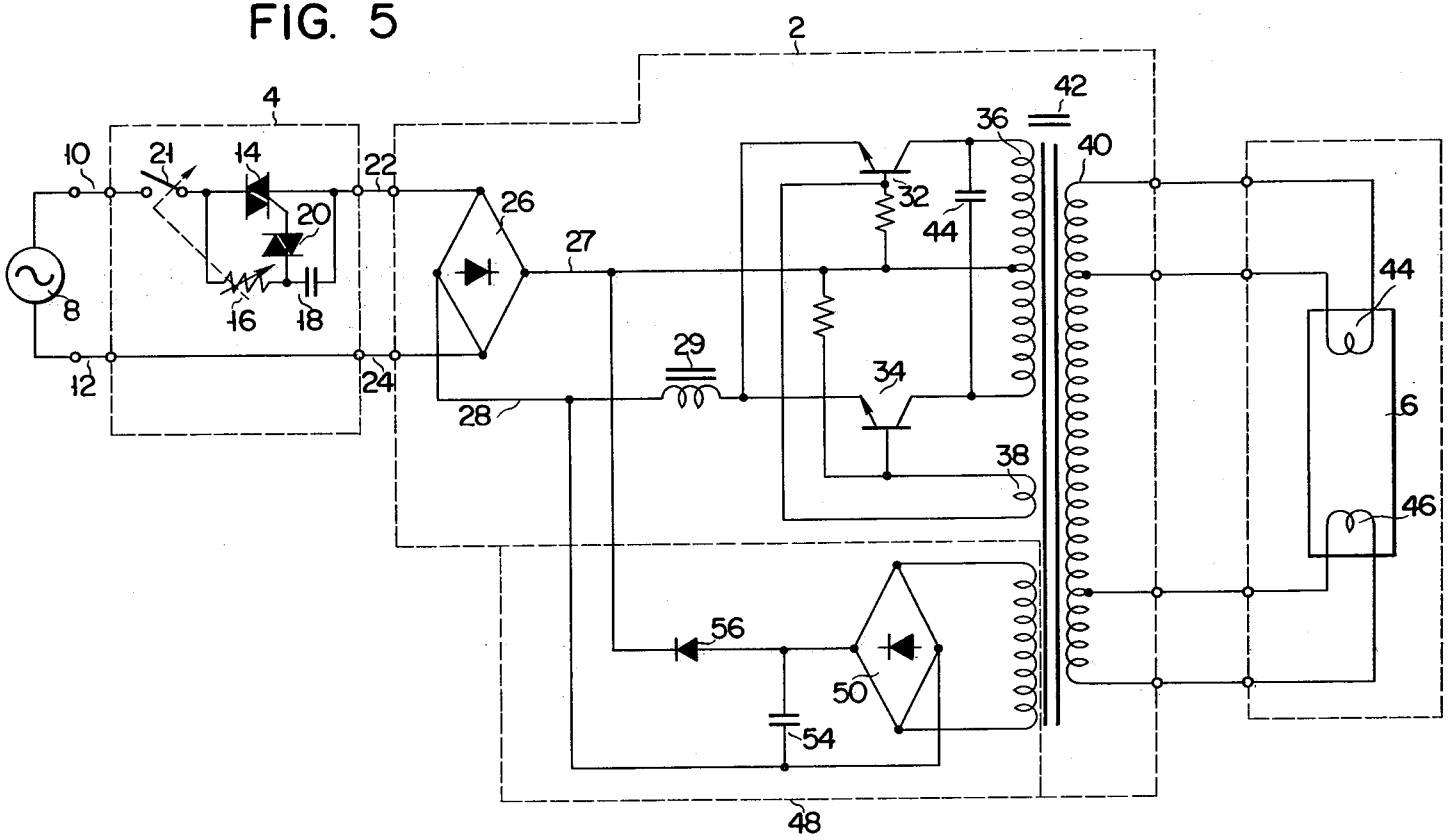
FIG. 5 is a circuit diagram illustrating an apparatus for operating a gaseous discharge lamp in accordance with another embodiment of the present invention.

A modification of the present invention will now be described referring to FIG. 5. In FIG. 5, the same parts are denoted by the same numerals as in FIG. 1, and their description is omitted. In the embodiment shown in FIG. 1, the rectifying circuit 50 is connected to the connecting wires 22, 24 through the transformer 52. However, instead of the transformer 52, in the embodiment shown in FIG. 5, the leakage reactance transformer 42 further has a tertiary winding 64 and is connected with the rectifying circuit 50 of the DC power source 48. The fluorescent lamp light control system shown in FIG. 5 is substantially the same as the system shown in FIG. 1, except that the voltage is supplied to the rectifying circuit 50 by the transformer 42, so that description of the operation is omitted. In the system shown in FIG. 5, the transformer 52 shown in FIG. 1 is unnecessary; thus, the operating circuit 2 of the system may be made more compact in size and less expensive. In this embodiment, when the phase controller 13 and the rectifying circuit 26 are assembled into unity, the rectifying circuit 26 can be connected to the high frequency generating unit 2 by the two wires.

Various modifications are possible without departing from the scope of the present invention. For example, in the embodiments shown in FIG. 1 and FIG. 5, the circuit for charging the capacitor 54 is not limited to a full-wave rectifying circuit, but may be a half-wave rectifying circuit. Further, the charging voltage of the capacitor 54 need not be determined by the turn ratio of the transformer 52, but may be determined by other means and the output voltage of the DC power source can be arbitrarily set.

What we claim is:

1. An apparatus for operating a fluorescent lamp comprising:
   - an AC power source for producing an AC voltage;
   - a power control means for controlling the phase angle of the AC voltage to generate a controlled output voltage during a power supply period in any half cycle of the AC voltage;
   - an auxiliary power source for generating an auxiliary voltage during at least a rest period between the power supply periods;
   - means for inverting the controlled output voltage and auxiliary voltage to a high frequency voltage; and
   - a fluorescent lamp having a filament, which is energized by the high frequency voltage wherein said auxiliary voltage supplied is of such a value that the output of said inverting means during said rest period is less than the discharge sustaining voltage of said fluorescent lamp and is sufficient to supply heating current to said filament.

2. An apparatus according to claim 1 wherein said power control means includes means for rectifying and smoothing the phase controlled output to generate a DC voltage.

3. An apparatus according to claim 1 wherein said auxiliary power source is supplied with a high frequency output from said inverting means for rectifying and smoothing said high frequency output.

4. An apparatus according to claim 1 or 2 wherein said auxiliary power source comprises a rectifying circuit connected to said AC voltage; a capacitor connected in parallel with said rectifying circuit for being charged thereby; and a diode for supplying a charging current from said capacitor to said inverting means when the voltage supplied from said rectifying means becomes less than the charging voltage of said capacitor.

5. An apparatus according to claim 1 or 3 wherein said auxiliary power source comprises a rectifying circuit for rectifying a high frequency voltage supplied by said inverting means; a capacitor connected in parallel with said rectifying circuit for being charged thereby; and a diode for supplying a charging current from said capacitor to said inverting means when the voltage supplied from said rectifying means becomes less than the charging voltage of said capacitor.

6. An apparatus according to any one of claims 1, 2 or 3 wherein said inverting means comprises an inverter including a pair of push-pull transistors; and a transformer, the primary winding of which is connected to said inverter and the secondary winding of which is connected to said gaseous discharge lamp.

* * * * *